US010518573B2

(12) United States Patent
Jordan

(10) Patent No.: US 10,518,573 B2
(45) Date of Patent: Dec. 31, 2019

(54) CHALK HOLDER

(71) Applicant: Robert Jordan, Kings Park, NY (US)

(72) Inventor: Robert Jordan, Kings Park, NY (US)

( * ) Notice: Subject to any disclaimer, the term of this patent is extended or adjusted under 35 U.S.C. 154(b) by 0 days.

(21) Appl. No.: 15/997,084

(22) Filed: Jun. 4, 2018

(65) Prior Publication Data

US 2019/0077184 A1 Mar. 14, 2019

Related U.S. Application Data

(60) Provisional application No. 62/558,805, filed on Sep. 14, 2017.

(51) Int. Cl.
*B43K 23/016* (2006.01)
*B43K 23/02* (2006.01)

(52) U.S. Cl.
CPC ..... *B43K 23/016* (2013.01); *B43K 23/02* (2013.01)

(58) Field of Classification Search
CPC .... B43K 23/016; B43K 23/00; B43K 23/004; B43K 23/012; B43K 23/02; B43K 23/04; B43K 23/06
See application file for complete search history.

(56) References Cited

U.S. PATENT DOCUMENTS

| | | | | |
|---|---|---|---|---|
| 2,687,116 | A * | 8/1954 | Sheets | A41H 9/02 15/435 |
| 3,046,663 | A | 7/1962 | Fred | |
| 3,102,742 | A * | 9/1963 | Shurcliff | B43K 23/016 401/34 |
| 4,415,092 | A * | 11/1983 | Boyer | B43K 23/001 211/59.2 |
| 5,063,681 | A | 11/1991 | Bradley | |
| 6,276,854 | B1 * | 8/2001 | Mullins | B43K 23/016 401/131 |
| 6,470,581 | B1 | 10/2002 | Kolodzieski | |
| 6,663,305 | B2 * | 12/2003 | Poulos | B43K 23/02 15/435 |
| 7,028,411 | B1 | 4/2006 | Kasche | |
| 2007/0068021 | A1 | 3/2007 | Fisher | |

* cited by examiner

*Primary Examiner* — David J Walczak
(74) *Attorney, Agent, or Firm* — Gloval Intellectual Property Agency, LLC; Daniel Boudwin

(57) ABSTRACT

A chalk holder for children's games. To be used in combination with the tine portions of garden rakes to apply uniform pressure and to create evenly spaced lines when drawing on sidewalks, pavements, or other surfaces. Evenly spaced lines to be used to define the borders for games like hop scotch or to define lanes for foot races.

12 Claims, 5 Drawing Sheets

CHALK HOLDER

CROSS REFERENCE TO RELATED APPLICATION

This application claims the benefit of U.S. Provisional Application No. 62/558,805 filed on Sep. 14, 2017. The above identified patent application is herein incorporated by reference in its entirety to provide continuity of disclosure.

BACKGROUND OF THE INVENTION

The present invention relates to games played by children that involve drawing with chalk.

When left to their own devices children often come up with simple games that they can play by themselves or with friends. In some instances, these games can involve drawing on the sidewalk or on walls with pieces of chalk. For example, games like hop-scotch, games involving racing tracks with lanes, or sometimes drawing just for the sake of drawing. Whatever the specifics of the game may be, if it involves drawing on a surface with chalk the children may struggle to draw evenly spaced lines or to apply uniform pressure as they draw, and they are also likely to get chalk all over their hands and their clothes while they draw. The present invention provides a simple solution that makes it easier for anyone drawing with chalk to create evenly spaced lines, or to apply uniform pressure. Additionally, the present invention will reduce the likelihood of the person drawing making a mess and getting chalk all over his/herself.

Devices have been disclosed in the known art that relate to chalk holders. These include devices that have been patented and published in patent application publications. These devices generally relate to handles and other means of holding and drawing on the ground with chalk. However, none of these known art devices provide the configuration for drawing evenly spaced lines while applying uniform pressure disclosed by the presently claimed invention.

In light of the devices disclosed in the known art, it is submitted that the present invention substantially diverges in design elements from the known art and consequently it is clear that there is a need in the art for an improvement to existing chalk holding devices. In this regard the instant invention substantially fulfills these needs.

SUMMARY OF THE INVENTION

In view of the foregoing disadvantages inherent in the known types of chalk holders now present in the known art, the present invention provides a new chalk holder wherein the same can be utilized for providing convenience for the user when drawing with chalk.

It is therefore an object of the present invention to provide a new and improved chalk holding device that has all of the advantages of the prior art and none of the disadvantages.

It is another object of the present invention to provide a chalk holder comprised of a housing having a channel disposed therein to receive a piece of chalk.

Another object of the present invention is to provide a chalk holder equipped with a longitudinal slit in the surface of the housing to accommodate chalk pieces of varying size.

A further object of the present invention is to provide a chalk holder equipped with a slot into which the tine of a rake can be inserted to convert the rake into a drawing device.

Yet another object of the present invention is to provide a chalk holder comprised of an arch-shaped housing having arcuate upper portion and a planar lower portion to prevent uncontrolled rolling and to keep the chalk holder in an upright standing position.

An additional object of the present invention is to provide a chalk holder with molded indicia disposed on the surface of thereof.

Another object of the present invention is to provide a chalk holder that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
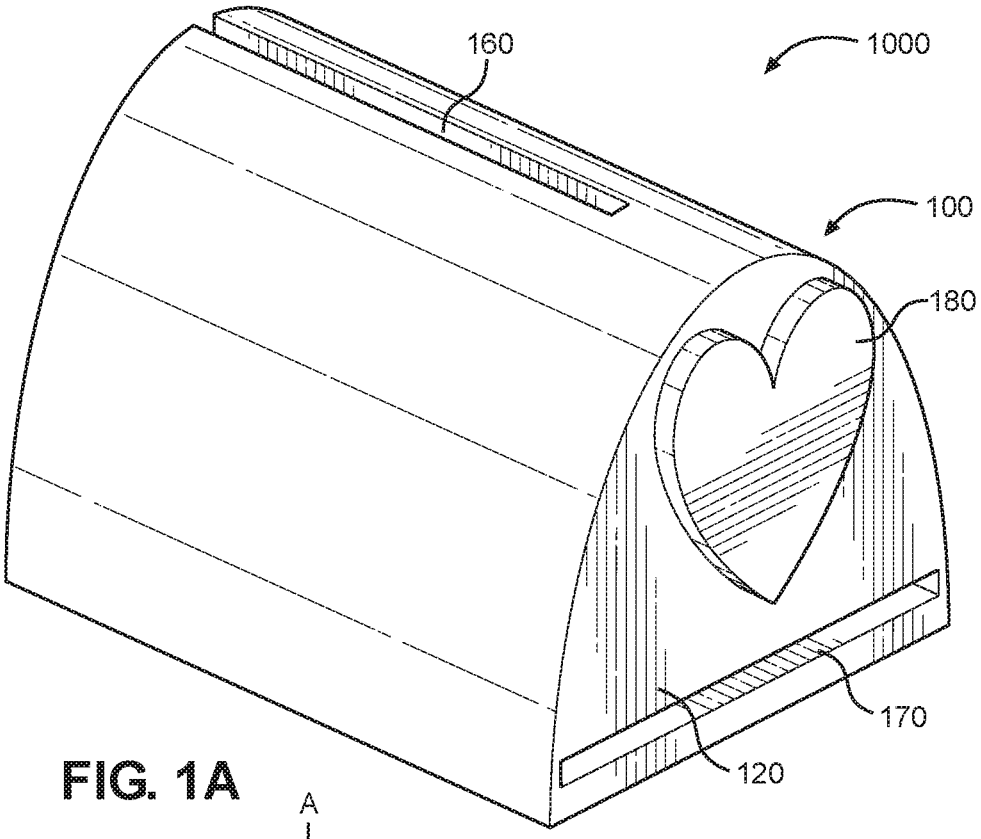
FIG. 1A shows a perspective view of an embodiment of the chalk holder facing behind.

Reference is made herein to the attached drawings. Like reference numerals are used throughout the drawings to depict like or similar elements of the chalk holder. For the purposes of presenting a brief and clear description of the present invention, the preferred embodiment will be discussed as used for a chalk holder. The figures are intended for representative purposes only and should not be considered to be limiting in any respect.

Figure 1B:
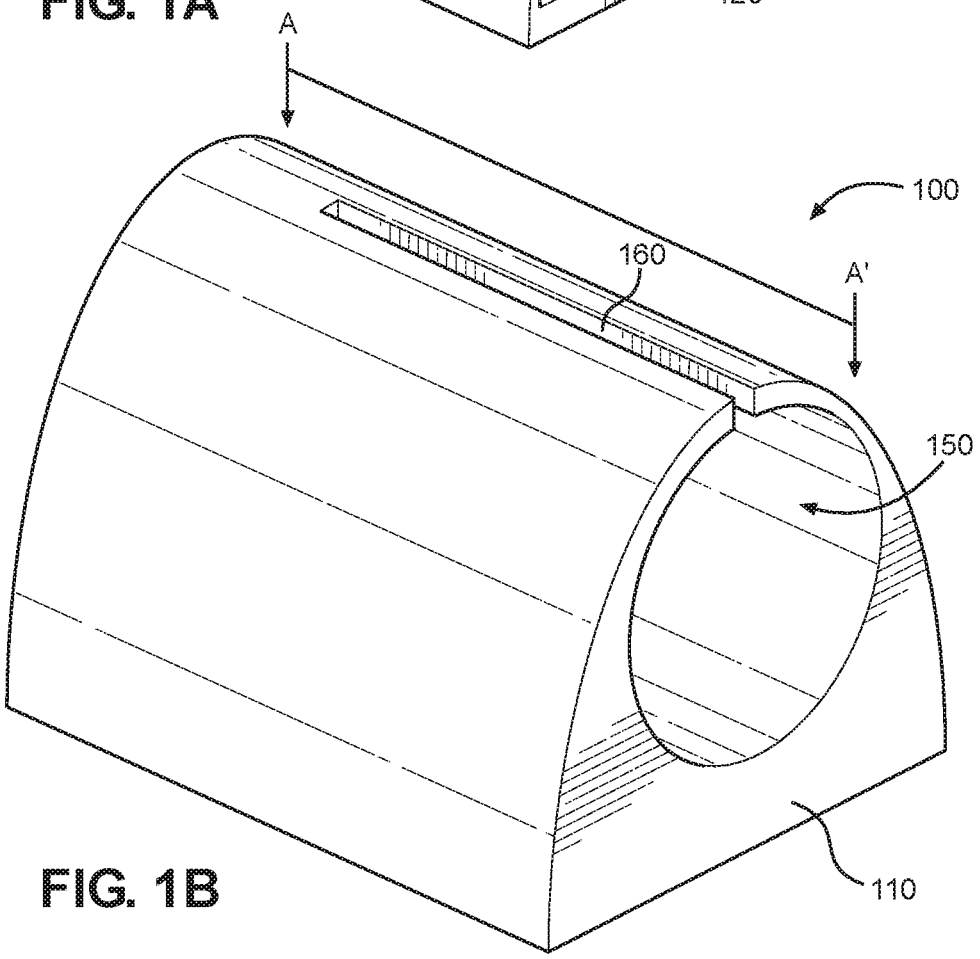
FIG. 1B shows a perspective view of an embodiment of the chalk holder facing forward.

Referring now to FIGS. 1A & 1B, there are shown a perspective views of an embodiment of the chalk holder facing behind and facing forward respectively. The chalk holder 1000 comprises an arch-shaped housing 100 having an open first end 110 and an open interior channel 150 sized and proportioned to receive a piece of chalk therein, such that the inner surface of the channel frictionally engages the inserted piece of chalk. Frictional engagement of the channel 150 ensures that when inserted the piece of chalk is removably attached to the chalk holder 1000. In the illustrated embodiment, the channel 150 is circular in shape to accommodate the most commonly available shape of chalk. However, other embodiments can include channels of other shapes. For example, a rectangular shaped channel could receive a piece of rectangular shaped chalk that will allow for the breadth of lines drawn to change depending on which way the chalk holder is oriented. Another possibility could be to make the channel 150 large enough for multiple pieces of chalk to be inserted therein to create multi-colored lines when drawing.

The arch-shaped housing 100 further includes a slot 170 that is disposed in a closed second end 120, and a longitudinal slit 160 positioned at the apex of the arch-shaped housing 100 that extends from the open first end 110 toward the closed second end 120, such that the slit 160 cuts through the housing 100 into the open interior channel 150. The slot 170 is shaped and proportioned for the tine of a rake to be inserted therein so that the rake can be converted into a drawing instrument. In use multiple chalk holders 1000 can be installed together on multiple tines of a single rake to create multiple evenly spaced lines when drawing. The embodiment illustrated in FIG. 1A includes a heart shaped indicium 180 disposed on the second end 120, such that the indicium 180 slightly protrudes outward relative to the surrounding surface of the second end 120. Other embodiments can include indicia of other forms to further personalize the chalk holder.

Figure 2A:
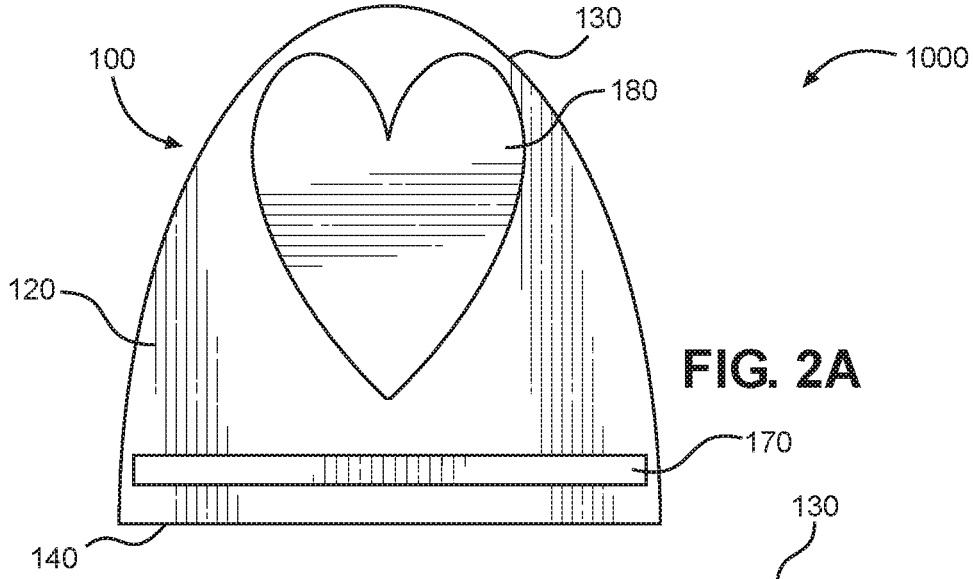
FIG. 2A shows a back view of an embodiment of the chalk holder.
Figure 2B:
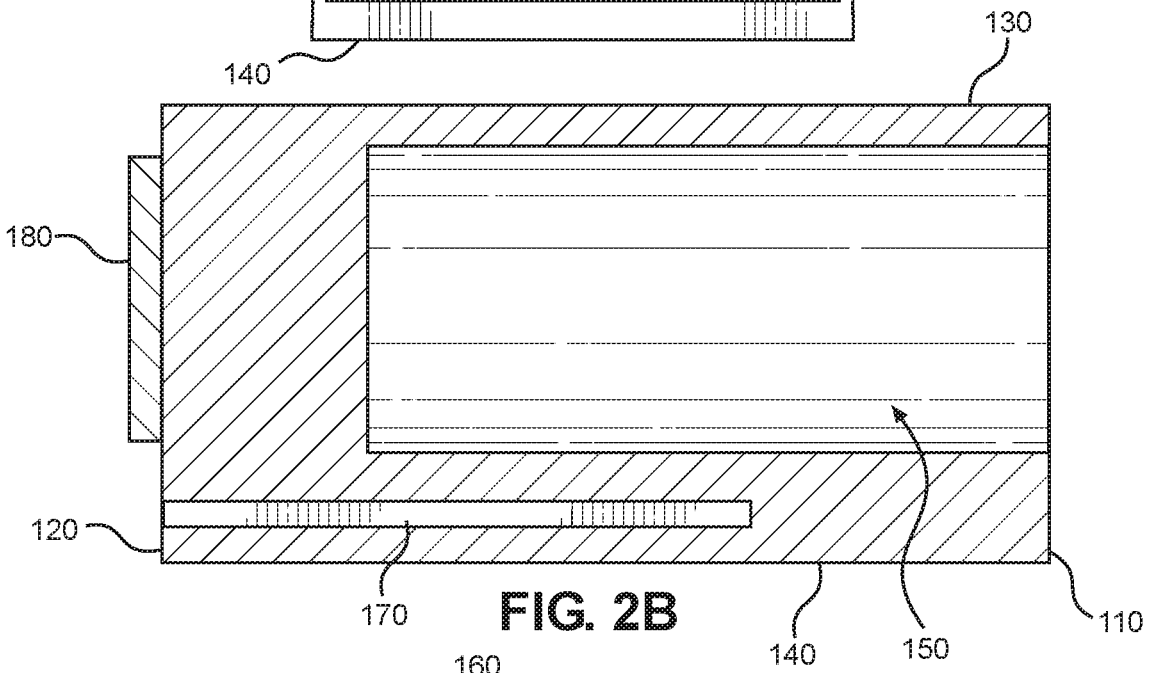
FIG. 2B shows a cross-sectional side view along line AA' of an embodiment of the chalk holder.
Figure 2C:
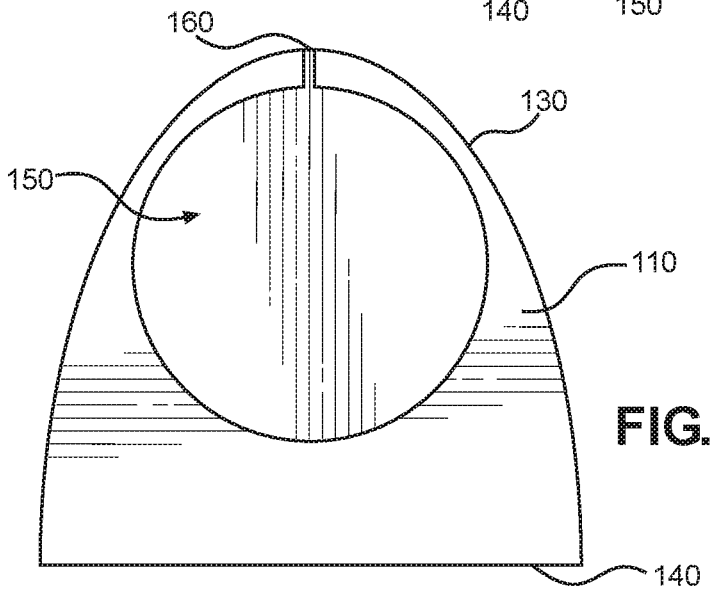
FIG. 2C shows a front view of an embodiment of the chalk holder.

Referring now to FIGS. 2A, 2B and 2C there are shown a back view, a cross-sectional view along line AA', and a front view of an embodiment of the chalk holder respectively. The arch-shaped housing 100 further includes an arcuate upper portion 130, and a planar lower portion 140 configured to prevent uncontrolled rolling and to keep the housing in an upright standing position. Also mentioned before but more clearly shown here, the housing 100 includes an indicium 180 that slightly protrudes outward relative to the surrounding surface of the second end 120.

In the illustrated embodiment, the open interior channel 150 is a circular hole bored into the body of the housing 100, such that the channel 150 begins at the first end 110 and extends toward the second end 120. The depth of the channel 150 is shown to extend appreciably beyond halfway to the second end to provide greater stability and security to the piece of chalk when inserted therein. Additionally, the position of the channel 150 is closer to the apex of the upper potion 130 than to the planar lower portion 140. Positioning the channel 150 closer to the upper portion of the housing sufficiently increases the thickness of the lower portion to allow for the slot 170 disposed in back end 120 to also be built into the housing without compromising the structural integrity of either element. Like the channel 150, the depth of the slot 170 is shown to extend from the second end 120 to appreciably beyond halfway to the first end 110 to provide greater stability and security to the rake tine inserted therein.

The longitudinal slit 160 is positioned at the apex of the arch-shaped housing 100 to facilitate insertion of larger pieces of chalk. In the event that a piece of chalk larger than the channel 150 is to be inserted into the housing 100, the slit 160 is able to spread apart to a degree to expand the overall size of the channel 150. The degree of spread is determined by the structural properties of the material used to form the housing. Furthermore, the longitudinal slit 160 also provides an additional means of removing a piece of chalk inserted into the channel 150 when the inserted chalk has been worn down through excessive use to be flush with the first end 110.

Figure 3:
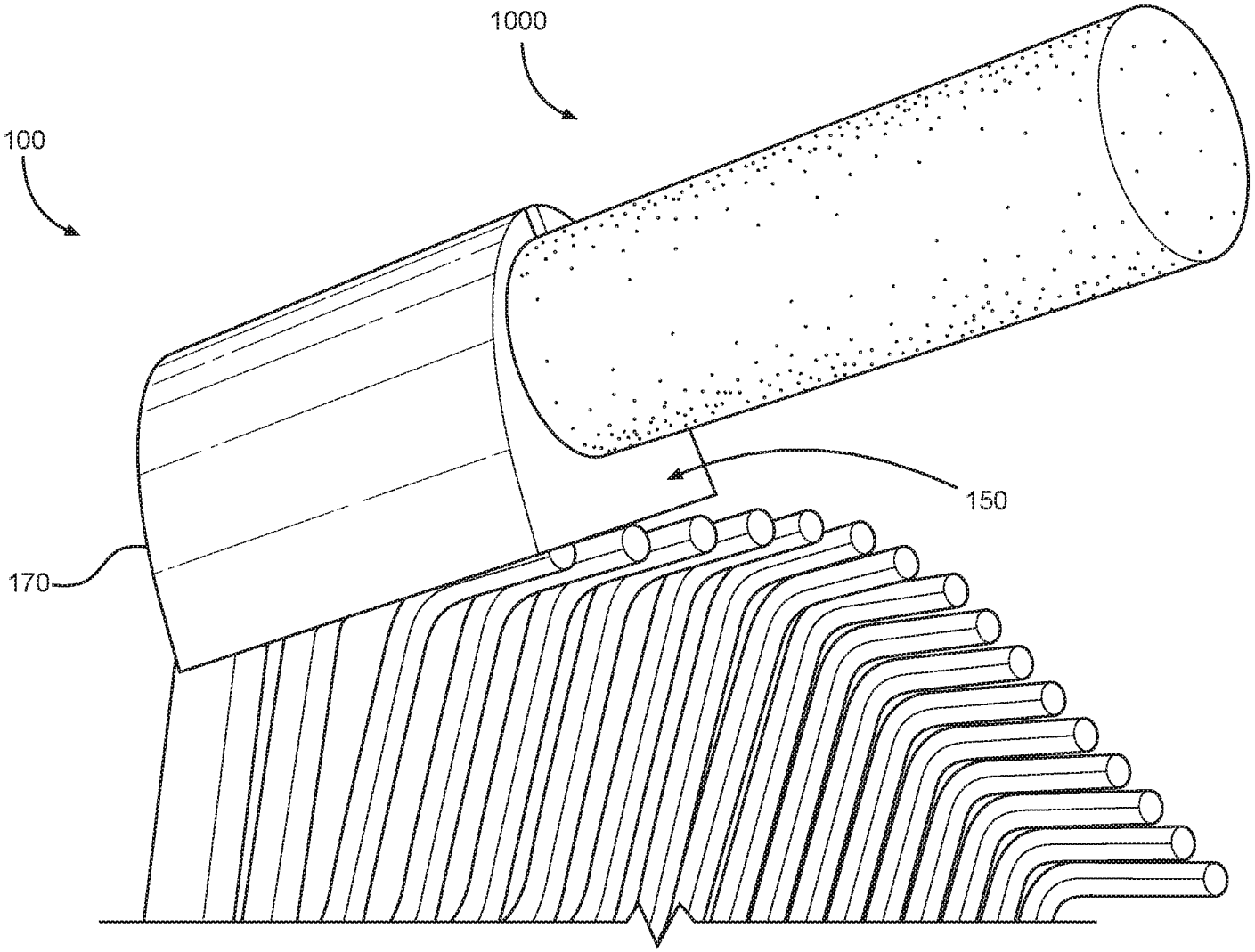
FIG. 3 shows a perspective view of an embodiment of the chalk holder with a rake tine inserted into the slot disposed on the back-end of the housing.
Figure 4:
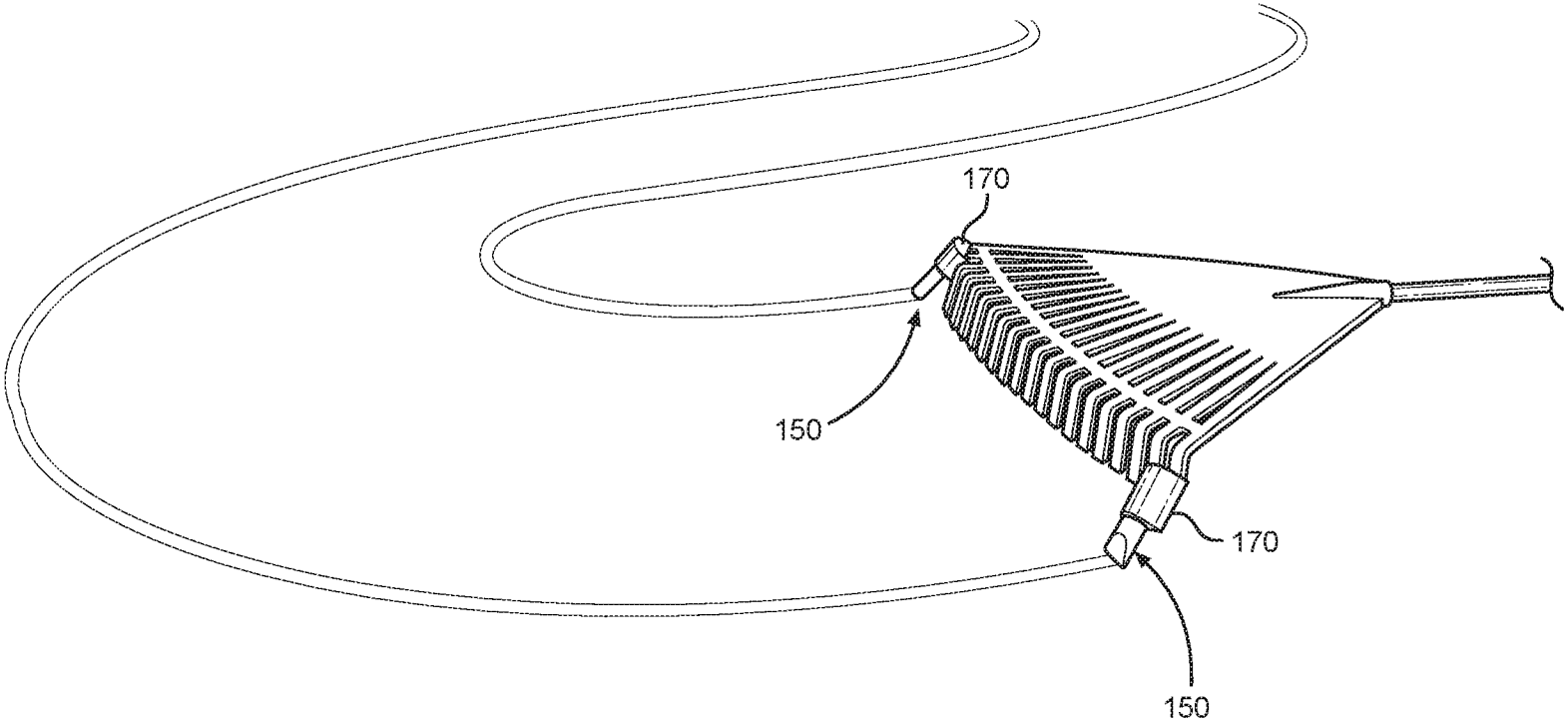
FIG. 4 shows a perspective view of an embodiment of the chalk holder in use with a rake being used to draw evenly spaced lines on pavement.

Referring now to FIGS. 3 and 4, there are shown a perspective view of an embodiment of the chalk holder with a rake tine inserted into the slot disposed on the back-end of the housing and a perspective view of an embodiment of the chalk holder in use with a rake being used to draw evenly spaced lines on pavement. Here, a piece of chalk is inserted into the open interior channel 150 on the first end 110 of the housing 100, while a tine of a rake is inserted into the slot 170 on the second end 120 of the housing 100. Using this configuration with two chalk holders 1000 on the two outermost tines of a rake converts the rake into a drawing device that can produce two uniformly spaced lines that can be used to define a lane of a track.

Figure 5A:
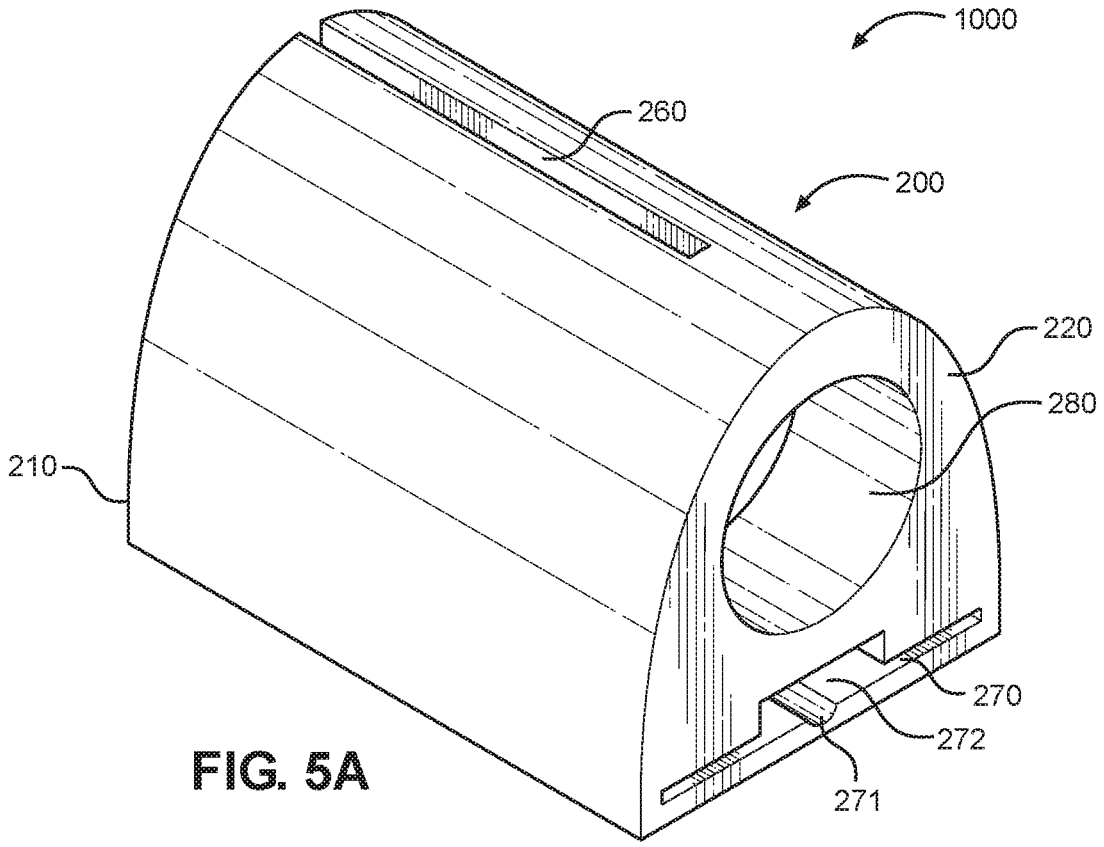
FIG. 5A shows a perspective view of an alternate embodiment of the chalk holder facing behind.
Figure 5B:
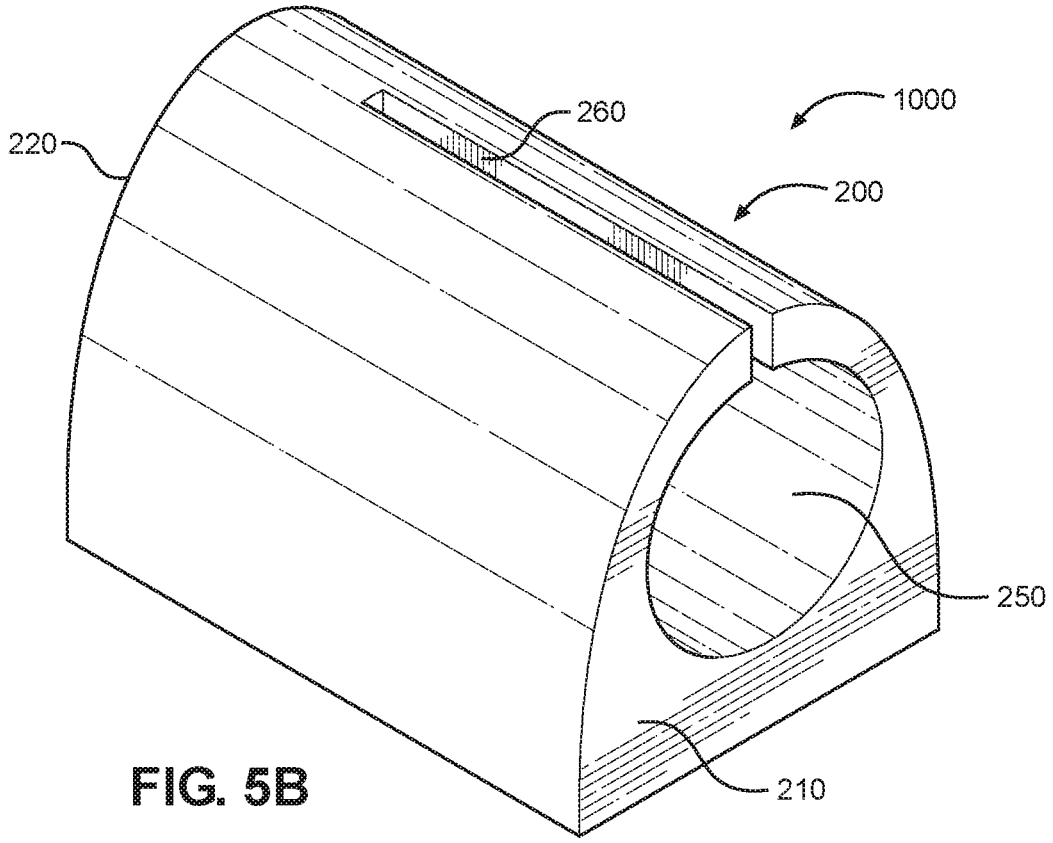
FIG. 5B shows a perspective view of an alternate embodiment of the chalk holder facing forward.

Referring now to FIGS. 5A and 5B, there are shown perspective views of an alternate embodiment of the chalk holder facing behind and facing forward respectively. In the illustrated embodiment the chalk holder 1000 primarily comprises an arch-shaped housing 200 and a longitudinal slit 260 positioned at the apex of the housing 200, such that the slit 260 extends from the open first end 210 toward the closed second end 220, and the slit 260 cuts through the housing 200 into the open interior channel 250.

Additionally, the second end 220 of the housing 200 includes a circular bore 280 through to the open interior channel 250 instead of a decorative indicium. The circular bore 280 can be used to identify what color chalk is currently inserted into the chalk holder 1000, and also provides a secondary means for removing chalk from the housing 1200. A user can guide an inserted piece of chalk up out of the housing through the open first end 210 by pushing on the chalk from behind through the circular bore 280 disposed in the second end.

Furthermore, the slot 270 shaped and proportioned to receive the tine of a rake has been further modified to include a curved groove 271 on its lower end and secondary slot 272 on its upper end. The curved groove 271 and the secondary slot 272 reduce the amount of physical contact between the chalk holder 1000 and the inserted tine of a rake, which thereby reduces the overall amount of frictional force securing the inserted tine of a rake to the interior surface of the slot 270. As such, the curved groove 271 and the secondary slot 272 are configured to allow for the inserted tine of a rake to be more easily removed from the chalk holder 1000.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk holder, comprising;

a housing having an open first end and an open interior channel sized and proportioned to receive a piece of chalk therein;

the housing further including an upper portion, and a planar lower portion configured to prevent uncontrolled rolling and to keep the housing in an upright standing position;

a longitudinal slit disposed in the upper portion of the housing, such that the slit cuts through the housing into the open interior channel and extends back from the open first end towards a closed second end;

a slot disposed in the closed second end of the housing, such that the tine of a rake can be inserted therein;

wherein the open interior channel is bored closer to the upper portion of the housing than to the planar lower portion.

2. The chalk holder of claim 1, wherein the housing is arc-shaped, and further includes an arcuate upper portion such that the longitudinal slit cutting through the housing to the open interior channel is aligned with the apex of the arch.

3. The chalk holder of claim 1, wherein a circular bore through to the open interior channel is disposed in the closed second end of the housing, such that an inserted piece of chalk can be removed from the housing by pushing on the chalk from behind through the circular bore disposed in the second end.

4. The chalk holder of claim 1, wherein a molded indicium is disposed in the closed second end of the housing.

5. The chalk holder of claim 1, wherein the open interior channel is circular in shape.

6. The chalk holder of claim 1, wherein the surface of the open interior channel is configured to frictionally engage the inserted piece of chalk, such that when inserted the chalk is removably attached to the chalk holder.

7. A chalk holder, comprising;

a housing having an open first end and an open interior channel sized and proportioned to receive a piece of chalk therein;

the housing further including an upper portion, and a planar lower portion configured to prevent uncontrolled rolling and to keep the housing in an upright standing position;

a longitudinal slit disposed in the upper portion of the housing, such that the slit cuts through the housing into the open interior channel and extends back from the open first end towards a closed second end;

a slot disposed in the closed second end of the housing, such that the tine of a rake can be inserted therein;

wherein the open interior channel is bored closer to the upper portion of the housing than to the planar lower portion;

wherein the thickness of the housing is greater in the planar lower portion beneath the open interior channel than in the upper portion above the open interior channel.

8. The chalk holder of claim 7, wherein the housing is arc-shaped, and further includes an arcuate upper portion such that the longitudinal slit cutting through the housing to the open interior channel is aligned with the apex of the arch.

9. The chalk holder of claim 7, wherein a circular bore through to the open interior channel is disposed in the closed second end of the housing, such that an inserted piece of chalk can be removed from the housing by pushing on the chalk from behind through the circular bore disposed in the second end.

10. The chalk holder of claim 7, wherein a molded indicium is disposed in the closed second end of the housing.

11. The chalk holder of claim 7, wherein the open interior channel is circular in shape.

12. The chalk holder of claim 7, wherein the surface of the open interior channel is configured to frictionally engage the inserted piece of chalk, such that when inserted the chalk is removably attached to the chalk holder.

* * * * *